US010773530B2

(12) United States Patent
Zocco et al.

(10) Patent No.: US 10,773,530 B2
(45) Date of Patent: Sep. 15, 2020

(54) PRINTING MACHINE

(71) Applicant: ARIOLI S.P.A., Gerenzano (VA) (IT)

(72) Inventors: Carmelo Zocco, Saronno (IT); Pasquale Cannone, Milan (IT)

(73) Assignee: Arioli S.P.A., Gerenzano (VA) (IT)

( * ) Notice: Subject to any disclaimer, the term of this patent is extended or adjusted under 35 U.S.C. 154(b) by 0 days.

(21) Appl. No.: 16/315,537

(22) PCT Filed: Jul. 5, 2017

(86) PCT No.: PCT/IB2017/054045
§ 371 (c)(1),
(2) Date: Jan. 4, 2019

(87) PCT Pub. No.: WO2018/007954
PCT Pub. Date: Jan. 11, 2018

(65) Prior Publication Data

US 2019/0389229 A1 Dec. 26, 2019

(30) Foreign Application Priority Data

Jul. 5, 2016 (IT) ..... 102016000069773

(51) Int. Cl.
*B41J 19/00* (2006.01)
*B41J 3/407* (2006.01)
*B41J 25/00* (2006.01)

(52) U.S. Cl.
CPC ..... *B41J 3/4078* (2013.01); *B41J 19/00* (2013.01); *B41J 25/001* (2013.01)

(58) Field of Classification Search
None
See application file for complete search history.

(56) References Cited

U.S. PATENT DOCUMENTS 5,730,048 A * 3/1998 Averill ..... B41F 5/24 101/37
2002/0170446 A1* 11/2002 Willcocks ..... A23G 3/2023 101/36

(Continued)

FOREIGN PATENT DOCUMENTS

CN 102 582 244 A 7/2012
CN 104 385 774 A 3/2015

(Continued)

OTHER PUBLICATIONS

International Search Report and Written Opinion dated Sep. 14, 2017, issued in PCT Application No. PCT/IB2017/054045 fled Jul. 5, 2017.

(Continued)

*Primary Examiner* — Erica S Lin
(74) *Attorney, Agent, or Firm* — Workman Nydegger

(57) ABSTRACT

An oval printing machine includes a guide, defining a closed path (P); one or more supports, movable on the guide, the one or more supports being adapted to support items to be printed; one or more operating stations positioned along the path (P) for processing the items to be printed; at least one digital printing station positioned along the path (P), for printing the items supported by the one or more supports. The digital printing station includes a structure substantially integral with the guide, and a first printing element associated with the structure and movable relative to the structure. The printing element is movable in a first direction (D1) that is transversal to a second direction (D2) in which the guide extends at the digital printing station.

14 Claims, 7 Drawing Sheets

(56) References Cited

U.S. PATENT DOCUMENTS

| | | | |
|---|---|---|---|
| 2005/0257738 | A1 | 11/2005 | Tateishi et al. |
| 2006/0249039 | A1 | 11/2006 | Feldman et al. |
| 2007/0068403 | A1 | 3/2007 | Fresener et al. |
| 2011/0032300 | A1 | 2/2011 | Ben-Zur et al. |

FOREIGN PATENT DOCUMENTS

| | | | |
|---|---|---|---|
| EP | 2 875 958 | A1 | 5/2015 |
| WO | 2011-069596 | A1 | 6/2011 |

OTHER PUBLICATIONS

International Preliminary Report dated Aug. 28, 2018, issued in PCT Application No. PCT/IB2017/054045 fled Jul. 5, 2017.

* cited by examiner

PRINTING MACHINE

BACKGROUND OF THE INVENTION

1. The Field of the Invention

The present invention relates to a printing machine, in particular a printing machine for textiles.

More in detail, the invention relates to a printing machine of the oval type.

2. The Relevant Technology

As is known, oval printing machines are fitted with a plurality of plates movable along guides that define a closed path (typically oval); the items to be printed, e.g., garments such as, for example, T-shirts or the like, are positioned on the plates. The plates carry the items to be printed to operating stations arranged along the path of the guides. The operating stations may be silkscreen printing stations, drying stations, stations for "flocking" applications, stations for "foiling" applications, etc.

The Applicant has noticed that the machines known in the art often suffer from important operational limitations.

By way of example, let us consider the case wherein a "flocking" application is required on a digitally printed fabric. The machines currently available cannot appropriately fulfil this requirement. In fact, after having been digitally printed on a different machine, the item must be picked up from that machine, re-positioned on a plate of the oval machine, and then subjected to the desired treatment.

This clearly implies a number of drawbacks, which are due both to the time necessary for moving the item and to the substantial impossibility of positioning the item in a precise manner for executing the "flocking" application with high accuracy relative to the already printed parts.

Note that this is only one example, among many others, that may be useful to comprehend the need, felt by the Applicant, for broadening the functionality of traditional oval machines.

The Applicant has also observed that the oval silkscreen printing machines known in the art involve very high costs, particularly as concerns the construction of printing matrices. Such costs are industrially bearable only for large production volumes. In other words, the machines known in the art suffer from important criticalities from an economical viewpoint when they have to be used for small production volumes, e.g., samples, which may be limited to as few as 40 items per lot.

OBJECTS AND SUMMARY OF THE INVENTION

It is therefore one object of the present invention to provide an oval printing machine that offers broadened functionality.

It is another object of the invention to provide an oval printing machine that involves bearable industrial costs for large and small volumes.

It is a further object of the invention to provide an oval printing machine that allows operation at variable printing speed and quality, depending on the requirements of every single production lot.

It is yet another object of the present invention to provide an oval printing machine that can exploit at best the waiting times entailed by the operations being carried out.

These and other objects are substantially achieved through a printing machine as described in the appended claims.

BRIEF DESCRIPTION OF THE DRAWINGS

Further features and advantages will become more apparent from the following detailed description of some preferred but non-limiting embodiments of the invention.

This description will refer to the annexed drawings, which are also provided merely as explanatory and non-limiting examples, wherein.

DETAILED DESCRIPTION OF THE INVENTION

With reference to the appended drawings, numeral 1 designates a printing machine in accordance with the invention.

The printing machine 1 is preferably an oval printing machine for textiles.

The machine 1 comprises, first of all, a guide 10 that defines a path P.

Preferably, the path P is a closed path.

The path P may have a circular, elliptical, oval, etc. shape.

Figure 2:
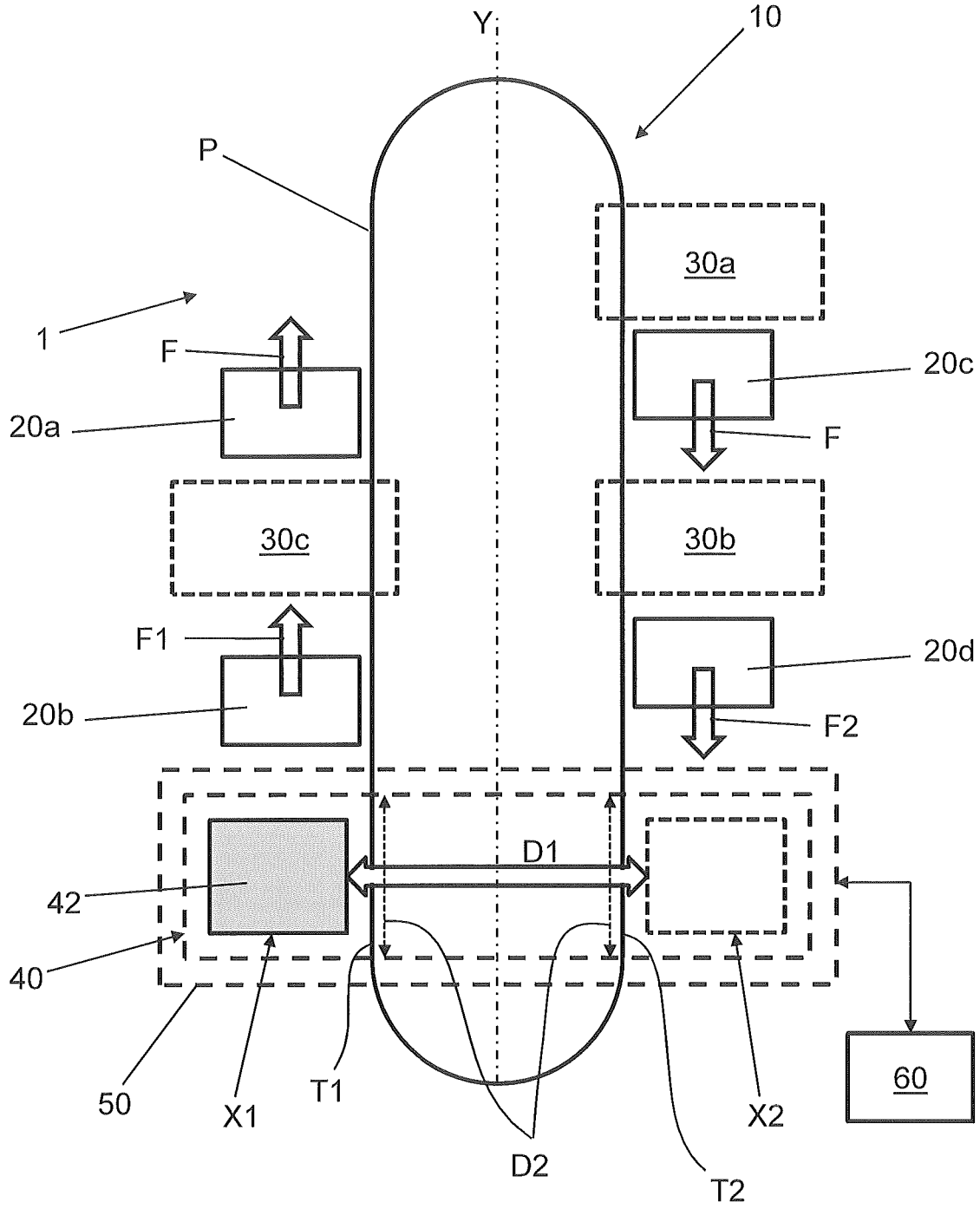
FIG. 2 is a simplified plan view of the machine of FIG. 1.
Figure 3:
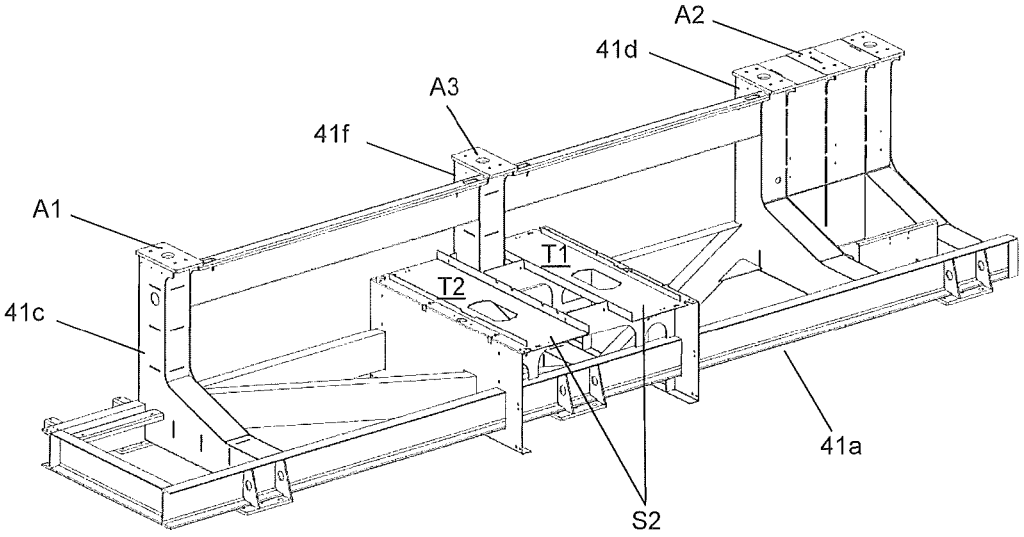
FIGS. 3 and 4 are perspective views of some elements of the machine of FIG. 1.
Figure 4:
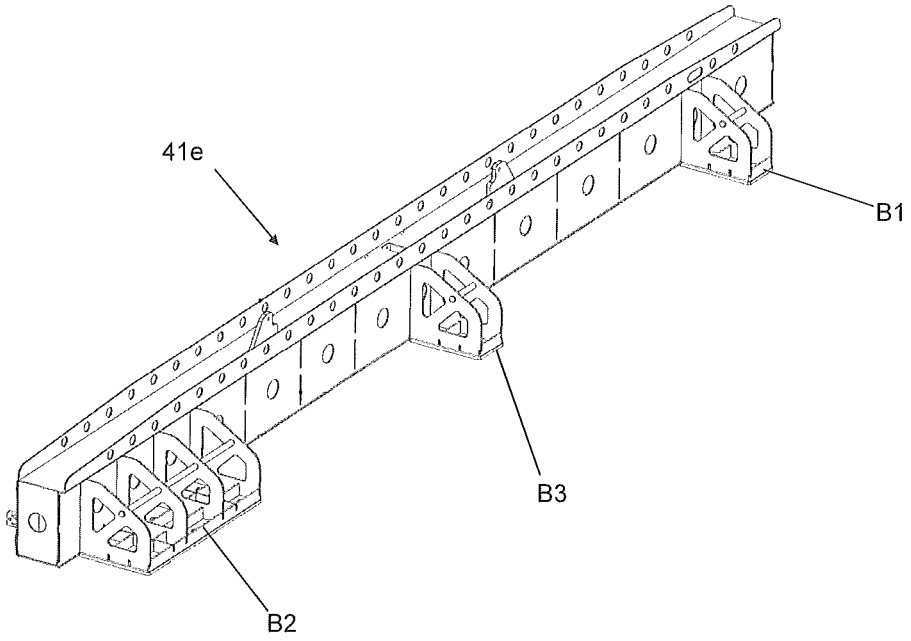
Figure 5:
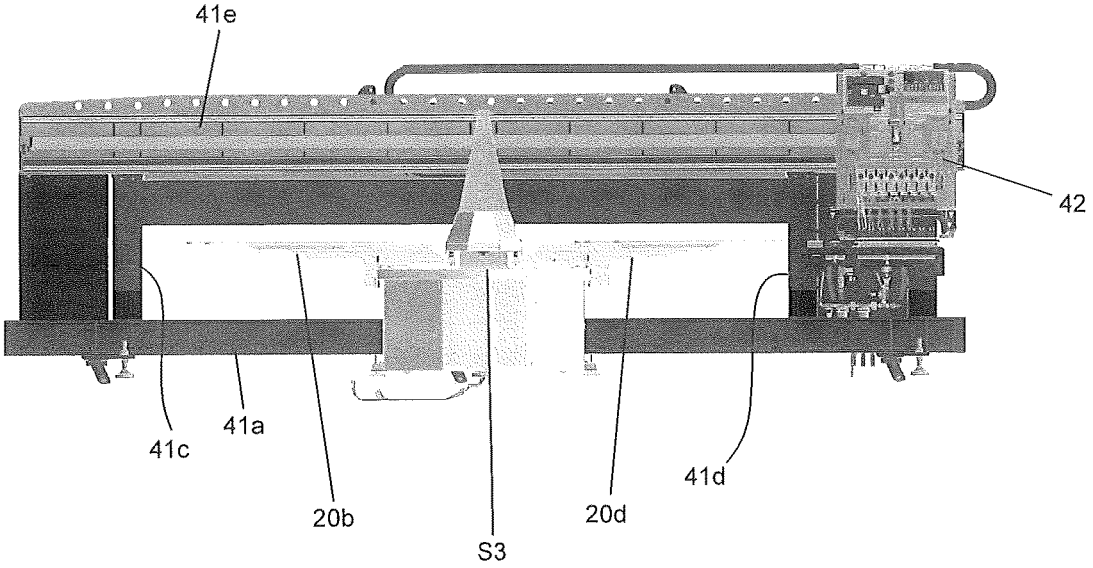
FIG. 5 is a front view of the machine of FIG. 1.

In one embodiment, the path P has two straight sides parallel and close to each other, and two curved portions that connect the homologous ends of said straight sides, as schematically shown by way of example in FIG. 2.

The machine 1 further comprises one or more supports 20*a*-20*d* that are movable on the guide 10.

The supports 20*a*-20*d* are adapted to support items to be printed, e.g., garments.

The supports 20*a*-20*d* may consist, in practice, of plates, e.g., substantially rectangular in shape, whereon the textile items to be printed can be laid.

In particular, on each support 20*a*-20*d* a respective item to be printed can be arranged.

The supports 20*a*-20*d* are fitted with suitable drive members engaged with the guide 10, so that the supports 20*a*-20*d* can be moved on the guide 10 along the path P, as schematically shown by arrows F1, F2 in FIG. 2.

The supports 20*a*-20*d* can be moved by using different techniques. Some examples that may be taken into account are the driving technique described in International patent application no. PCT/IB2015/059212 by MACHINES HIGHEST MECHATRONIC GMBH, or the technique described in European patent no. EP 2 509 791 B1 to Arioli S.p.A.

It should be noted, however, that the invention is also applicable to printing machines wherein the supports for the items to be printed are moved according to techniques other than those mentioned above.

The machine 1 further comprises one or more operating stations 30*a*-30*c* positioned along said path P for processing the items to be printed.

Advantageously, the operating stations 30*a*-30*c* comprise at least one silkscreen printing station.

Preferably, the operating stations 30*a*-30*c* comprise one or more of:

a drying station;

a flocking station;

a foiling station;

a fixing station;

a preparation station;

a station for loading/unloading the items onto/from the supports 20*a*-20*d*.

In accordance with the invention, the machine 1 further comprises a digital printing station 40.

The digital printing station 40 is arranged in a specific position along the path P for digitally printing the items supported by the supports 20*a*-20*d*.

The printing station 40 comprises a structure 41 substantially integral with the guide 10.

The structure 41 preferably comprises a base 41*a* and a frame 41*b*.

The frame 41*b* is preferably mounted on the base 41*a* and supports the first printing element 42, which will be described later on.

Preferably, the frame 41*b* comprises first and second uprights 41*c*-41*d*, each one extending from a respective portion of said base 41*a*.

Preferably, the frame 41*b* comprises also a third upright 41*f*, interposed between said first upright 41*c* and said second upright 41*d*.

Preferably, the frame 41*b* further comprises a first crosspiece 41*e* mounted on said uprights 41*c*-41*d*.

Preferably, the first crosspiece 41*e* is supported also by said third upright 41*f*.

In particular, the first and second uprights 41*c*, 41*d* have respective engagement zones A1, A2 adapted to be constrained to corresponding constraint zones B1, B2 of said first crosspiece 41*e*.

Advantageously, also the third upright 41*f* has an engagement zone A3, adapted to be coupled to a corresponding constraint zone B3 of the first crosspiece 41*e*.

Preferably, the two uprights 41*c*-41*d* are located on opposite sides of the guide 10, so that the first crosspiece 41*e* extends over two distinct portions of the guide 10.

Figure 1:
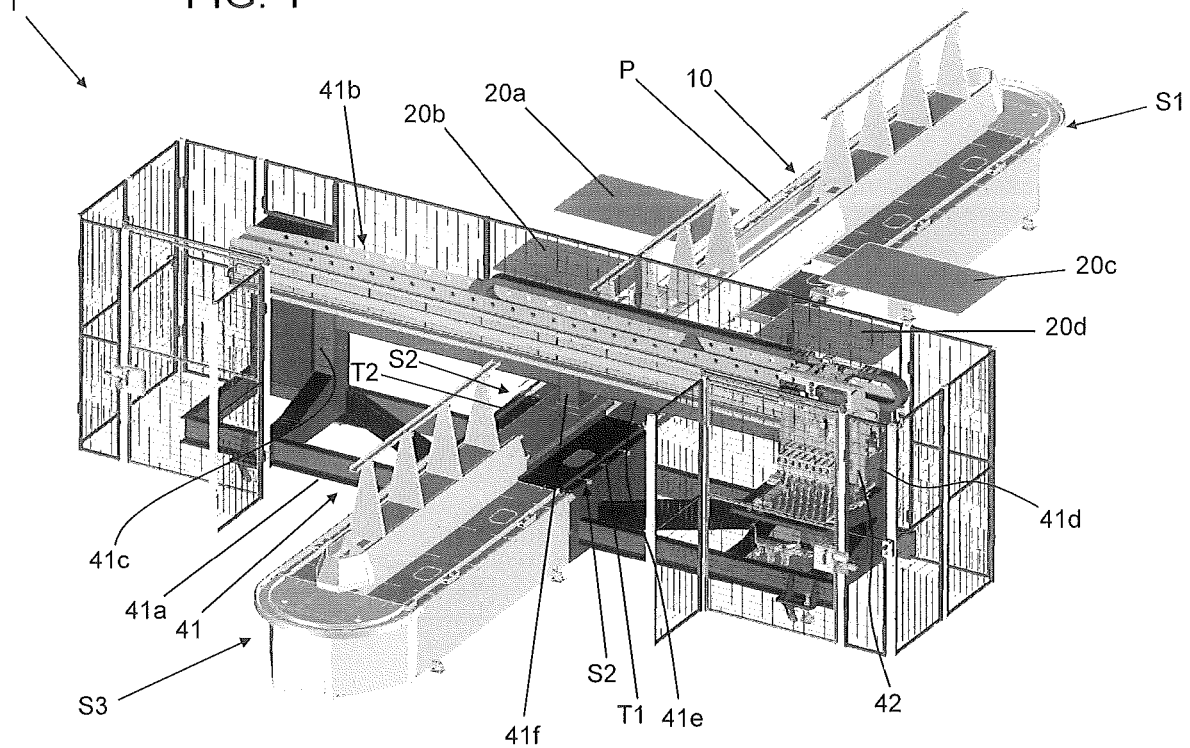
FIG. 1 is a schematic perspective view of a machine in accordance with the present invention.

In other words, in a preferred embodiment both uprights 41*c*-41*d* are located externally to the closed path P, as shown in FIG. 1, preferably in substantially symmetrical positions relative to the median axis Y of the guide 10.

Preferably, the third upright 41*f* is located within the area delimited by the path P (FIG. 1).

As aforementioned, the digital printing station 40 further comprises a first printing element 42 associated with the structure 41 and movable relative to the structure 41.

The function of the first printing element 42 is to carry out digital printing operations on the items supported by the supports 20*a*-20*d*.

Preferably, the first printing element 42 can accommodate a number N of colour heads. This number N is related to the machine configuration.

Preferably, the machine configuration takes into account the following factors:

Print width (in the direction D2 of FIG. 2): the number N of print heads grows with the value of this parameter; in particular, the number N can be determined by the following relation: N=(design print width/head footprint), rounded up;

Number of colours: the higher this datum, the higher the number N of heads. This is a direct relationship when the head can only use one colour; conversely, if multiple-channel heads are used, it will be necessary to consider the maximum number of channels and the maximum number of colours to be used. In this respect, it must be pointed out that the minimum number of colours is 4 (CMYK four-colour process);

Minimum print resolution: this datum depends on the native resolution of the head.

All heads of one colour will have to be arranged along the same direction (parallel to the direction D2 indicated in FIG. 2) and, for the purpose of ensuring drop spacing uniformity, each head must be mechanically constrained to the printing element in such a way that the last nozzle of the preceding head will be positioned, relative to the first nozzle of the next head, at a distance equal to 1"/(native resolution of the head in dpi). Constant nozzle pitch will thus be ensured throughout the row of heads of the same colour along the direction D2.

The head arrays thus arranged will ensure, as the first printing element 42 moves along the direction D1, printing at native resolution in the direction D2.

Merely by way of example, heads having a native resolution of 150 dpi may be taken into consideration. Due to the above-described arrangement, when the first printing element 42 is moved at its maximum speed (along the direction D1), printing will occur at a resolution of 150 dpi (direction D1)×150 dpi (direction D2). Or, by moving the first printing element 42 at a lower speed along the direction D1, it will be possible to print at a resolution of 300 dpi (direction D1)×150 dpi (direction D2).

If one wants to print at a higher resolution than the native resolution of the head (along the direction D2), it will be necessary to multiply said machine configuration by a predefined factor K. The final resolution achieved in the direction D2 will be equal to the next integer of K*(native resolution in dpi).

It is important to underline that, when multiplying the machine configuration for the purpose of increasing the final resolution in the direction D2, the additional lines of colour heads will have to be mechanically constrained to the printing element in such a way that the nozzles of the additional head array will be so positioned as to provide an offset, in the direction D2, equal to half the pitch of the nozzles of the head array of the printing configuration at native resolution.

The Applicant also wishes to point out that the basic element of the printing element consists of a head of piezoelectric or thermal nature, capable of printing both fixed-size drops and variable-size drops, using the so-called DOD (Drop On Demand) concept or the ink circulation concept, and capable of using both pure inks (which is typical of the CMYK four-colour process) and pre-mixed inks (also known as spot colours).

The first printing element 42 is preferably constrained to the first crosspiece 41*e*, in a manner such that it can be moved along the first crosspiece 41*e*.

The first printing element 42 is preferably movable in a substantially straight line, along a first direction D1.

Preferably, the first direction D1 coincides with the longitudinal development of the first crosspiece 41*e*.

The first direction D1 is transversal to a second direction D2, in which the guide 10 extends at the digital printing station 40.

Preferably, the first direction D1 is substantially orthogonal to the second direction D2.

Merely by way of example, in the reference system of FIG. 2 the first direction D1 is horizontal, while the second direction D2 is vertical.

In one embodiment, the first printing element 42 cannot substantially be moved, while executing printing operations, along the second direction D2.

In this embodiment, the first printing element 42 can only be moved along the first direction D1 (in addition to vertically, towards/away from the item to be printed).

In one embodiment, the first printing element 42 can also be moved along the second direction D2, so as to create an offset between the trajectories (parallel to D1) followed during successive passes over the item(s) to be printed. This solution can be used, for example, in order to double the print resolution with the same printing element.

Preferably, the first printing element 42 is movable between a first position X1, in which it can execute a printing operation at a first tract T1 of the guide 10, and a second position X2, in which it can execute a printing operation at a second tract T2 of the guide 10.

Preferably, the first tract T1 and the second tract T2 are located on opposite sides relative to a median axis Y of the guide 10.

Preferably, the first tract T1 is substantially parallel to the second tract T2.

Preferably, the supports 20*a*-20*d* are moved over the first tract T1 in a first direction (arrow F1 in FIG. 2).

Preferably, the supports 20*a*-20*d* are moved over the second tract T2 in a second direction (arrow F2 in FIG. 2).

Preferably, the second direction is opposite to the first direction.

In other words, in a plan view like the one schematized in FIG. 2, a support 20*a*-20*d* is moved, for example, upwards in the first tract T1 and downwards in the second tract T2.

This is a consequence of the fact that, as aforesaid, the path P is a closed one and the support 20*a*-20*d* are always moved clockwise as schematically shown in FIG. 2 (or, in a variant embodiment not shown, counter clockwise) during a printing process.

Preferably, the third upright 41*f* is interposed between the first tract T1 and the second tract T2.

It is thus possible to print, through the first printing element 42, on two different items in a substantially simultaneous manner: the first item is supported by a support 20*a*-20*d* positioned on the first tract T1 of the guide 10, while the second item is supported by a support 20*a*-20*d* positioned on the second tract T2 of the guide 10.

The Applicant wishes to point out that this allows for more flexible and efficient management of the waiting times entailed by the printing operations.

In fact, the Applicant has verified that, when the digital printing station 40 operates on just one tract of the guide 10, i.e., only processes one item at a time, the time necessary for printing can be estimated to be approx. 4-5 seconds. Conversely, when the digital printing station 40 operates on two tracts (e.g., the above-mentioned first and second tracts T1, T2) of the guide 10, i.e., it processes two items during each printing step, the time required is approximately twice as much. In other words, there will be a pause of about 10 seconds between one movement of the supports and the next. This pause can advantageously be used for carrying out other operations (preparation, fixing, drying, positioning the items on the supports, etc.), which may require a time longer than 4-5 seconds and which may constitute a "bottleneck" in the timing of the entire process.

In other words, while keeping the throughput of the machine essentially unchanged (e.g., expressed as the number of totally treated items per hour, or items/hour), more time is available for operations that require it, so that they can be carried out in a more accurate, reliable and effective manner.

With this technical solution it is also possible to print the same fabric twice by means of the printing station 40: once at the first tract T1 and again at the second tract T2.

For moving the first printing element 42 vertically (i.e., orthogonally to the plane of the sheet, in the diagram of FIG. 2), along the direction D1 and, if available, along the direction D2, respective linear electric motors and/or pneumatic actuators can be used. Such motors/actuators are per se known, and will not therefore be described herein any further.

Figure 6A:
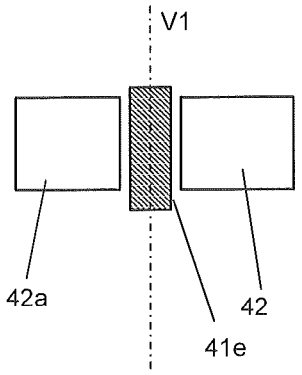
FIG. 6*a* shows a detail of one embodiment of the invention.
Figure 6B:
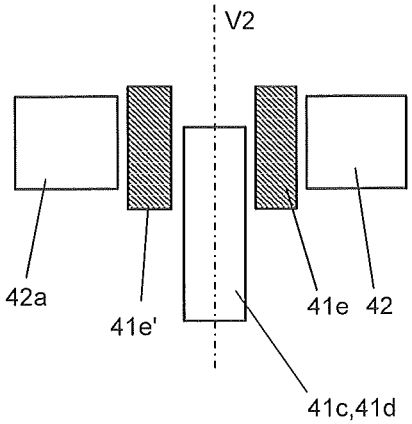
FIG. 6*b* shows a detail of one embodiment of the invention.
Figure 6C:
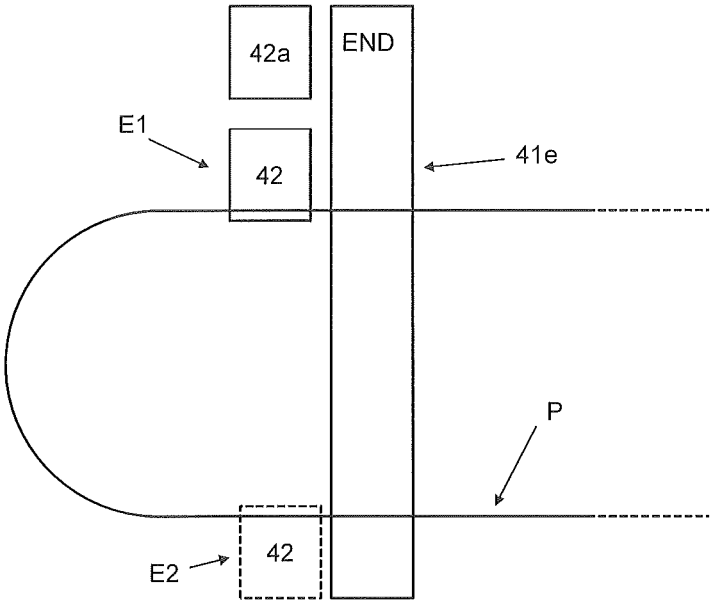
FIG. 6*c* shows a detail of one embodiment of the invention.

In one embodiment, the printing station 40 comprises, in addition to said first printing element 42, a second printing element 42*a* (FIGS. 6*a*-6*c*).

The second printing element 42*a* may essentially have the same technical features as the first printing element 42.

Preferably, the second printing element 42*a* is mounted on the first crosspiece 41*e*.

In one embodiment, the second printing element 42*a* is mounted on the first crosspiece 41*e* on the side opposite to that of the first printing element 42 with respect to a vertical plane V1 substantially parallel to the first direction D1 and passing through the first crosspiece 41*e*. FIG. 6*a* shows a schematic sectional view of this embodiment in a plane orthogonal to the longitudinal development of the first crosspiece 41*e*. The second printing element 42*a* can be made to move along the longitudinal development of the first crosspiece 41*e* by using technologies and modalities wholly similar to those described in regard to the first printing element 42.

In one embodiment, the second printing element 42*a* is mounted on a second crosspiece 41*e*' belonging to said frame 41*b* and supported by said uprights 41*c*, 41*d*. The second crosspiece 41*e*' is mounted on the uprights 41*c*, 41*d* on the side opposite to that of the first crosspiece 41*e* with respect to a vertical plane V2 substantially parallel to the first direction D1 and passing through the uprights 41*c*, 41*d*. FIG. 6*b* shows a schematic sectional view of this embodiment in a plane orthogonal to the longitudinal development of the first crosspiece 41*e*. The second printing element 42*a* can be made to move along the longitudinal development of the second crosspiece 41*e*' by using technologies and modalities wholly similar to those already described for the first printing element 42, with reference to the first crosspiece.

In one embodiment, the second printing element 42*a* is mounted on the first crosspiece 41*e* on the same side as the first printing element 42. Preferably, the length of the first crosspiece 41*e* in the longitudinal direction is such that the second printing element 42*a* can be kept inactive at a longitudinal end END of the first crosspiece 41*e*, while the first printing element 42 is operating on the first tract T1 and on the second tract T2. FIG. 6*c* shows a schematic plan view of this embodiment. The second printing element 42*a* is movable along the longitudinal development of the first crosspiece 42*a*, just like the first printing element 42. The movements of the first and second printing elements 42, 42*a* are controlled in such a way as to avoid any collisions. Note that the second printing element 42*a* may turn out to be advantageous, for example, for printing white colour on black fabric, before the first printing element 42 prints the actual colours on the same fabric. In addition or as an alternative, the second printing element 42*a* may be useful to print colours other than white, also on products not treated by the first printing element 42. In FIG. 6*c*, references E1, E2 indicate the outermost end-of-travel positions, with respect to the path P, taken by the first printing element 42. As can be observed, the length and position of the first crosspiece 41*e* are such that it can support the second printing element 42*a* with its own end END when the first printing element 42 is in the end-of-travel position E1 (i.e., the end-of-travel position proximal to the end END of the first crosspiece 41*e*).

Preferably, the guide 10 is partially formed in the structure 41 of the digital printing station 40.

In particular, the guide 10 has a first section S1 that extends from the digital printing station 40, a second section (S2) formed in the structure 41 of the digital printing station 40, and a third section S3 that extends on the opposite side of the digital printing station 40 with respect to the first section S1.

In practice, the second section S2 of the digital printing station 40 comprises said first tract T1 and second tract T2.

As aforesaid, the first crosspiece 41*e* extends over two distinct portions of the guide 10; said distinct portions are, advantageously, the first tract T1 and the second tract T2.

Preferably, the machine 1 further comprises an enclosure 50, within which said digital printing station 40 is located.

Preferably, the operating stations 30*a*-30*c* are not located within the enclosure 50.

In practice, the enclosure 50 delimits the spatial region in which only the digital printing station 40 extends.

Preferably, the enclosure 50 is associated with an adjustment system 60; the system 60 is configured for adjusting the temperature and/or humidity within the enclosure 50.

In this manner, the digital printing station 40 is allowed to operate under controlled environmental conditions, which are typically better than the general conditions of the structures where the machine 1 is located.

The Applicant has noticed, in fact, that printing machines are often used in geographical areas where the climate is particularly dry and the temperature can reach very high and/or very low values. This may lead to serious criticalities for digital printing, because print heads need certain temperature/humidity conditions to work properly. In particular, the Applicant has observed that, in environments where humidity is too low, the ink may dry on the heads, preventing them from operating properly. Likewise, excessively low or high temperatures may cause chemical/physical variations (e.g., viscosity, surface tension, etc.) in the inks, thus preventing correct drop formation.

Thanks to the enclosure 50 and the adjustment system 60, the digital printing station 40 can be made to work in adequate conditions, without nevertheless incurring heavy expenses.

From an operational viewpoint, the following must be pointed out.

The items to be printed are arranged on the supports 20*a*-20*d*.

The supports 20*a*-20*d* are then moved in order to carry and hold the items at the operating stations 30*a*-30*c* and/or at the digital printing station 40.

This means that the supports 20*a*-20*d* are moved to respective target positions, and are then held stationary in such positions in order to let the operating stations 30*a*-30*c* and/or the digital printing station 40 process the items.

Preferably, one of the supports 20*a*-20*d* is stopped on the first tract T1 of the guide 10, and another support 20*a*-20*d* is stopped on the second tract T2 of the guide 10.

In other words, said two supports are preferably stopped in different positions belonging to the second section S2 of the guide 10.

In this manner, the digital printing station 40 can process two different items during the same pause between the movements of the supports 20*a*-20*d*.

In the case wherein the digital printing station 40 operates on just one tract of the guide 10, only one of the supports 20*a*-20*d* will be positioned at the digital printing station 40.

Once the supports 20*a*-20*d* have been positioned, the respective stations 30*a*-30*c*, 40 can start processing the respective items.

When processing is complete, the supports 20*a*-20*d* will be moved again to carry the items to the next station.

The invention offers significant advantages.

First and foremost, the printing machine according to the present invention features broadened functionality, since it allows attaining a broader range of results compared to prior-art machines.

Furthermore, the machine according to the invention entails bearable industrial costs for large and small volumes.

A further advantage of the invention lies in the fact that the machine described and claimed herein can operate at variable printing speed and quality, depending on the requirements of every single production lot.

In addition, some preferred embodiments of the invention allow for better exploitation of the waiting times entailed by the operations being carried out.

The invention claimed is:

1. An oval printing machine comprising:

a) a guide, defining a closed path, the guide comprising a first tract and a spaced apart second tract;

b) one or more supports movable on said guide, said one or more supports being adapted to support items to be printed;

c) one or more operating stations positioned along said path for processing said items to be printed, said one or more operating stations comprising at least one silk-screen printing station;

d) at least one digital printing station positioned along said path, for printing the items supported by said one or more supports, wherein said digital printing station comprises a structure substantially integral with said guide, and a first printing element associated with said structure and movable relative to said structure, wherein said first printing element is movable in a first direction that is transversal to a second direction in which said guide extends at said digital printing station, wherein said first printing element is movable between a first position, in which said first printing element executes a printing operation at said first tract of said guide, and a second position spaced apart from the first position, in which said first printing element executes a printing operation at said second tract of said guide, wherein said first tract is substantially parallel to said second tract, wherein said one or more supports are moved on said first tract in a third direction, said third direction being parallel to said second direction, wherein said one or more supports are moved on said second tract in a fourth direction, opposite to said first direction.

2. The printing machine according to claim 1, wherein said one or more operating stations comprise one or more of:

a) a drying station;

b) a flocking station;

c) a foiling station;

d) a fixing station;

e) a preparation station;

f) a station for loading/unloading said items.

3. The printing machine according to claim 1, wherein said first direction is substantially orthogonal to said second direction.

4. The printing machine according to claim 1, wherein said first printing element cannot be substantially moved in said second direction.

5. The printing machine according to claim 1, wherein said first tract and said second tract are located on opposite sides with respect to a median axis of said guide.

6. The printing machine according to claim 1, wherein said guide is partially formed in the structure of said digital printing station.

7. The printing machine according to claim 6, wherein said guide has a first section that extends from said digital printing station, a second section formed in the structure of said digital printing station, and a third section that extends on the opposite side of said digital printing station with respect to said first section.

8. The printing machine according to claim 7, wherein the second section of said guide comprises said first tract and second tract.

9. The printing machine according to claim 1, wherein the structure of said digital printing station comprises:

a) a base;

b) a frame mounted on said base, wherein said frame supports said first printing element for digital printing operations.

10. The printing machine according to claim 9, wherein said frame comprises two uprights extending from respective portions of said base, and a first crosspiece mounted on said uprights, said first printing element being constrained to said first crosspiece.

11. The printing machine according to claim 10, wherein said uprights are located on opposite sides of said guide, so that said first crosspiece extends over two distinct portions of said guide.

12. The printing machine according to claim 11, wherein said distinct portions of said guide are said first tract and said second tract.

13. The printing machine according to claim 1, further comprising:

a) an enclosure, within which said digital printing station is located;

b) an adjustment system for adjusting the humidity and/or temperature within said enclosure.

14. An oval printing machine comprising:

a) a guide, defining a closed path, the guide comprising a first tract and a spaced apart second tract;

b) one or more supports movable on said guide, said one or more supports being adapted to support items to be printed;

c) one or more operating stations positioned along said path for processing said items to be printed, said one or more operating stations comprising at least one silk-screen printing station;

d) at least one digital printing station positioned along said path, for printing the items supported by said one or more supports, wherein said digital printing station comprises a structure substantially integral with said guide, and a first printing element associated with said structure and movable relative to said structure, wherein said first printing element is movable in a first direction that is transversal to a second direction in which said guide extends at said digital printing station, wherein said first printing element is movable, along said first direction, between a first position, in which said first printing element executes a printing operation at said first tract of said guide, and a second position spaced apart from said first position, in which said first printing element executes a printing operation at said second tract of said guide, wherein said first tract and said second tract are located on opposite sides with respect to a median axis of said guide, said median axis being parallel to said second direction, wherein said first tract is substantially parallel to said second tract, wherein said one or more supports are moved on said first tract in a third direction, said third direction being parallel to said second direction, wherein said one or more supports are moved on said second tract in a fourth direction, opposite to said third direction.

* * * * *